United States Patent [19]

Kakuya et al.

[11] Patent Number: 4,910,382

[45] Date of Patent: Mar. 20, 1990

[54] INFRA-RED HAIR DRYER

[75] Inventors: Yuji Kakuya; Masaharu Shindo, both of Osaka, Japan

[73] Assignee: Takara Belmont Kabushiki Kaisha, Osaka, Japan

[21] Appl. No.: 268,557

[22] Filed: Nov. 8, 1988

[30] Foreign Application Priority Data

Nov. 24, 1987 [JP] Japan ..... 62-293910
Jun. 9, 1988 [JP] Japan ..... 63-140632

[51] Int. Cl.[4] ..... A45D 20/14

[52] U.S. Cl. ..... 219/222; 34/97; 219/348; 219/377

[58] Field of Search ..... 132/212; 219/222, 347, 219/348, 377, 354; 34/96–101

[56] References Cited

U.S. PATENT DOCUMENTS

| | | | |
|---|---|---|---|
| 1,639,753 | 8/1927 | Shelton | 34/97 |
| 3,646,319 | 2/1972 | Auld | 219/347 |
| 4,191,879 | 3/1980 | Kerchner, Jr. | 219/347 |
| 4,263,500 | 4/1981 | Springer et al. | 219/377 |
| 4,323,761 | 4/1982 | Hubner | 219/377 |
| 4,382,174 | 5/1983 | Barns | 34/96 |
| 4,531,047 | 7/1985 | Canfield et al. | 219/347 |
| 4,691,451 | 9/1987 | Giorgis | 34/96 |

FOREIGN PATENT DOCUMENTS

| | | | |
|---|---|---|---|
| 922103 | 5/1947 | France | 219/377 |
| 1522777 | 8/1978 | United Kingdom | 219/377 |
| 2163898A | 3/1986 | United Kingdom | 219/354 |

*Primary Examiner*—A. D. Pellinen
*Assistant Examiner*—Geoffrey S. Evans
*Attorney, Agent, or Firm*—Lackenbach, Siegel, Marzullo & Aronson

[57] ABSTRACT

A hair drying apparatus consists of a curved radiation element for radiating of infrared rays and a reflector for supporting the radiation element and for reflecting infrared rays radiated from the radiation element. A rotating member is provided for rotatable support of the pivotal motion of the reflector. The hair drying apparatus has a drive engagement for activating a rotating member which includes a slip clutch mechanism stopping the rotation of the rotating member when the radiation element and the reflector strike an object during the rotation.

17 Claims, 6 Drawing Sheets

INFRA-RED HAIR DRYER

BACKGROUND OF THE INVENTION

1. Field of the invention

The present invention relates to a hair promoting apparatus, and more particularly to a hair promoting apparatus of the infrared-ray type for radiating infrared rays towards the human hair to be treated, so as to heat and dry it for the hair promoting processes such as drying after washing the hair, promotion of dyeing, perming, waving the hair and so on.

Hither-to-known hair promoting apparatuses of the above infrared-ray radiating type comprise an infrared radiator made of a heating wire such as a nichrome wire heated by an electric current flow being arranged in a tube composed of a silica glass, ceramic or the like, so that when it is heated the above tube radiators infrared rays to the human hair for hair processing treatment.

The elongated tube for radiating infrared rays (of all kinds) is of a linear configuration (hereinafter referred to as a heater), and a reflector having an arcuate cross section is arranged on the inner rear surface of the above heater so as to raise effectiveness of the radiation of infrared rays.

Besides, a plurality of infrared-ray radiating tubes are disposed at the top, rear and side portions of the human head, so that the infrared rays may be radiated uniformly on each portion thereof.

The hair promoting apparatus according to the above conventional type also occupies a vast area in a beauty salon or the like due to the fact that it requires a plurality of infrared-ray radiating tubes for surrounding the whole area of the human hair, which occasionally makes its installation impossible.

Furthermore, although a human head as a whole has nearly a circular configuration, considering the fact that the heater is of a fixedly located linear configuration, the uniform distance from the heater to each position of the human head cannot be possibly realized, whereby the radiation of infrared rays towards each position thereof is not uniform in quantity, resulting in that the temperature thereof is not uniform either.

By this reason, a rise of temperature is too abrupt only in some part thereof, so that the person being treated cannot endure, or due to the fact that the heater is fixedly located, only some parts thereof are heated and consequently the uniform radiation is not attained, making the promotion of the overall hair is short time impossible.

SUMMARY OF THE INVENTION

The present invention has been introduced in order to solve the aforementioned problems involved in the infrared rays radiating hair promoting apparatus according to the prior art.

It is therefore the first object of the present invention to equalize the distance between the heater and the human hair so as to provide the uniform radiation of infrared rays towards the whole area thereof by making the heater in a circular configuration, and also to enable the heater to radiate infrared rays on a wide area by making the heater rotate about a rotative member, realizing a compact hair promoting apparatus thereby.

It is also another object of this invention to promote the hair by blasting hot and cool air simultaneously or after the radiation of infrared rays to the human hair is completed.

The present invention relates to a hair promoting apparatus to achieve the above-mentioned objects, and its main purpose is to provide a ring-shaped or semicircular shaped heater for radiating infrared rays, a reflector for supporting the heater and also for reflecting the infrared rays radiated from the heater, a rotating member on which the reflector is arranged and rotatably supported for the pivotal motion thereof, and a drive means for activating the rotating member.

It is also preferable to provide the reflector with an inner cavity for forming a plurality of air blasting holes therein towards a human hair and at the same time to provide an air blower to blast air thereto.

Also, an air blower may be provided in the main body to blast air towards the reflector.

The hair promoting apparatus according to this invention is activated by rotating the rotating member by utilization of the drive means and, then rotating the heater and the reflector about the center of the rotating member as the rotation center thereof, enlarging the infrared-ray radiating area thereby.

Furthermore, by providing the heater in a circular configuration, the distance between the heater and a human head is equalized, so that the human head may then be settled in a position where the infrared rays may be radiated uniformly over the entire portion thereof.

The hair promotion is much more effectively performed if air is blasted toward the hair from the air blasting holes in the reflector while or after rays are radiated.

It may be more effective if the air is blown out to the hair from an air blower which is provided in the main body.

DETAILED DESCRIPTION OF THE EMBODIMENTS

The above and other objects and features of the present invention will become apparent upon reading the following detailed description of the embodiments with reference to the accompanying figures 1 to 7.

Figure 1:
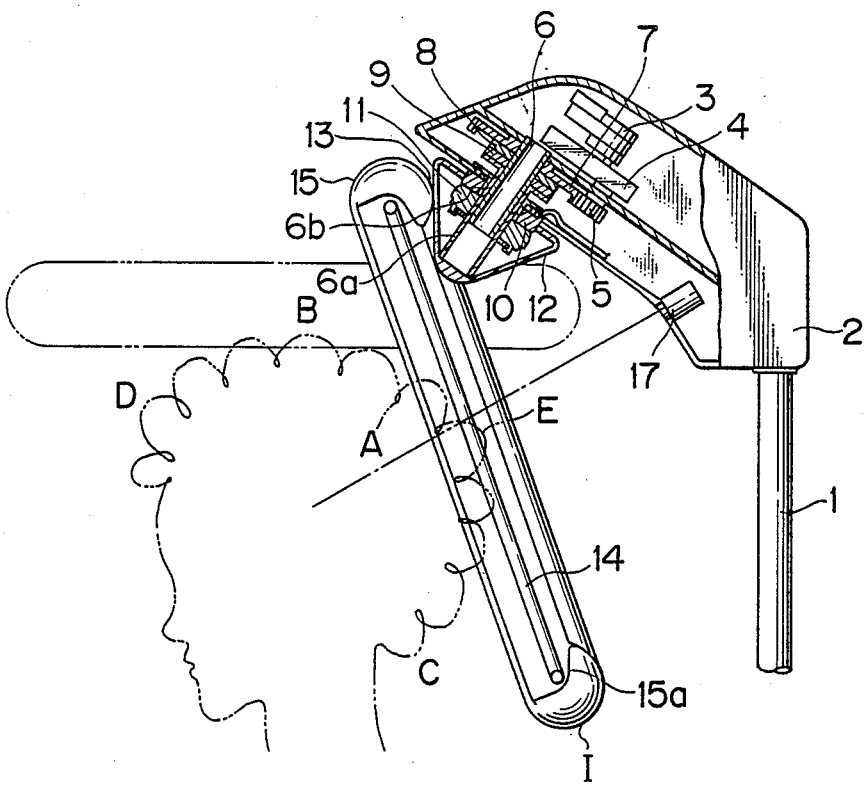
FIG. 1 is a sectional view of the first embodiment according to the present invention.
Figure 2:
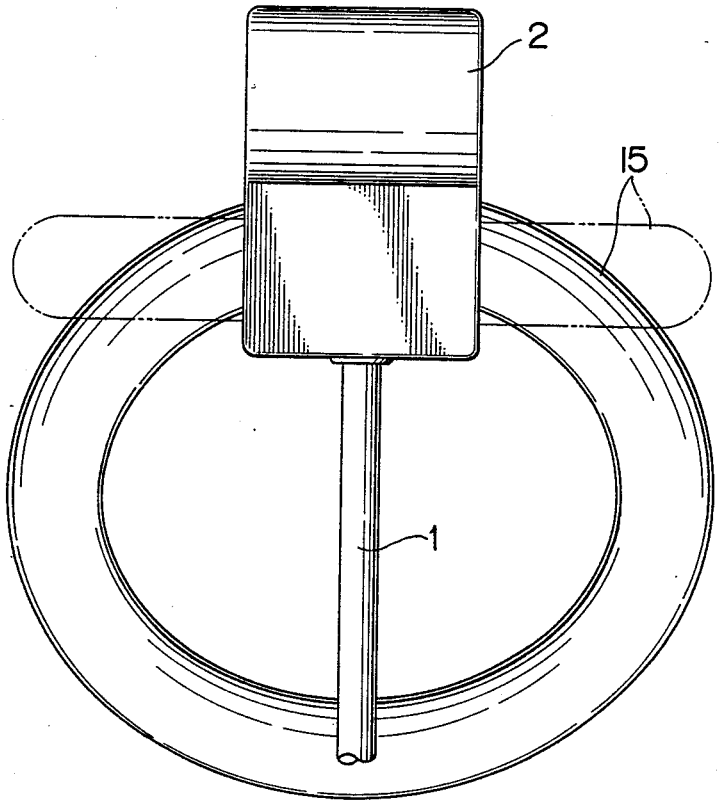
FIG. 2 is a rear side view of FIG. 1.
Figure 3:
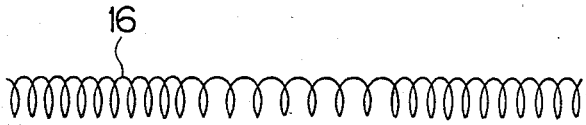
FIG. 3 is a developed view of a heating line.

FIG. 1 to FIG. 3 show the first embodiment of the present invention. In the figures, 1 denotes a lever for raising or lowering the apparatus in accordance with the height of a human head, and a main body case 2 is fixed at the upper end thereof.

Inside the main body case 2, a motor 3, a speed reduction gear 4 activated by the motor 3, a transmission main gear 5 engaged with the reduction gear 4, and a gear 7 engaged with the transmission gear 5 and also loosely fitted to a hollow shaft 6 which is fixed to the main body case 2 are accomodated therein.

To the gear 7 a magnet 8 is fixed, to which a magnet 9 that is loosely fitted to the hollow shaft 6 is also fixed.

In the above structure, when the motor 3 is activated to rotate, the rotation is transmitted to the speed reduction gear 4 for reducing the rotational speed thereby, then to the main gear 5 so as to be transmitted also to the gear 7, whereby the magnet 9 is activated to rotate through the magnet 8 which is fixed to the above gear 7.

Accordingly, when the obstructing force is applied to the rotational movement of the magnet 9, it is slipped from the magnet 8 against the absorbent force between the magnet 8 and 9.

As explained above, here the rotational speed of the motor 3 is gradually reduced while it is transmitted to the gears 4, 5 and 7 in turn and finally transmitted to the magnet 8, but the speed reduction means is not limited to the gear means and it may be worm-gear reduction or a belt reduction. Similarly, the rotating directions is not limited to only one way either, but can be bidirectional as well.

The above embodiment shows the case in which a slip clutch is adopted taking advantage of the absorbent force between the magnet 8 and 9, but it may be of a spring tension or of a slip velt.

A rotating tube 6*a*, one end of which is fixed to the magnet 9, is loosely fitted to the hollow shaft 6, and outside the above rotating tube 6*a* a fixed tube 6*b*, one end of which is fixed to the main body case 2, is loosely fitted. Furthermore, to the fixed tube 6*b* the fixed side power feeder 10 is attached, and a rotatable side power feeder 11 is attached to the rotating tub 6*a*.

The fixed side power feeder 10 is connected to the main power supply, whereas the rotatable side power feeder 11 is connected to a heater 14 which is explained afterwards, and consequently the heater 14 is connected to the main power supply through both sides of the power feeders 10 and 11.

At the top end of the above-mentioned rotating tube 6*a*, a rotating bracket 12 for covering the above both power feeders 10 and 11 is fixed, and to the arm thereof, a reflector 15 for supporting a ring-shaped heater 14 is arranged in such a way that its mounting angle is adjustable.

The rotatable side power feeder 11 rotates in accordance with the movement of the hollow shaft 6, receiving the electric power supplied to the fixed side power feeder 10 which is connected to the main power supply.

The heater 14 accomodates an elongated tube made of a silica glass, ceramic or the like with a heating wire 16 stored therein, which is connected to the rotatable side power feeder 11.

The elongated tube made of a silica glass, ceramic of the like is red heated by conducting the heating wire 16 so as to radiate infrared rays or far infrared rays, and these radiated infrared rays are further reflected by the reflector 15, so that they are concentratedly radiated on the opposite direction thereof.

The reflecting surface 15*a* of the reflector 15 is thus arcuatedly formed as shown in FIG. 1, and the heating wire 16 accomodated in the heater 14 comprises a finely wound portion and a roughly wound portion, both of which being supported in such a way that the roughly wound portion is located near the rotating bracket 12, whereas the finely wound portion is located remote therefrom.

The above-mentioned embodiment regulates that the heater is made of a heating wire with a finely wound portion and a roughly wound portion formed therein so as to differentiate the temperature therebetween, but the heater may be divided into many of small portions thereof so that the hair promotion (drying, perming, etc.) may also be performed by controlling on/off operations of each thereof.

Also, a non-contact type thermometer 17 is arranged in the surface of the main body case 2 of the heater 14 side for detecting the temperature of the heated object according to the quantity of the infrared rays reflected from the surface thereof.

The method of using the hair promoting apparatus and the function mode thereof are explained below.

First of all, adjust the lever 1 for raising or lowering the apparatus in accordance with the height of a human head A for settlig the level thereof as shown in FIG. 1, then energize the motor 3 and the heater 14. The rotation of the motor 3 is then transmitted to the reflector 15 via the reduction gear 4, transmission main gear 5, gear 7, magnets 8, 9 rotating tube 6*a*, and rotating bracket 12 one after another, and accordingly, since the reflector 15 is eccentrically rotated around the center axis of the hollow shaft 6, the rotation will be started from the location shown in full lines and then through the location illustrated in dot-dash lines finally returns to the same location as shown in full lines.

During this operation, the heater 14 is conducted to radiate the infrared rays to the hair. In this situation, the range between B and C of the hair is heated when the heater is located in the position illustrated in full lines in FIG. 1, while when located in the position illustrated in dot-dash lines, the range between D and E is heated.

Accordingly, as best shown in FIG. 1, a part of a heat [the range] between points B and E (or an upper posterior portion of a head) is constantly heated [,]. [whereas the range] Parts of a head between points D and B (or an anterior part of a head) and a part of a head between points E and C (or a lower posterior part of a head) are irregularly heated depending on the rotation of the heater 14 [,]. In view of that [that is] [like] temperature of [in these ranges] the anterior and lower posterior portions is always lower than that of [in] the [range] upper posterior portion or between points B and E.

Therefore, in order to equalize the rise of temperature in the whole area of the head, the radiation of infrared rays in the range between B and E or the upper posterior portion should be rather weak, while it should become stronger according as the heater comes round to E or to D, and thus the heating wire 16 must be wound partly fine and partly rough as illustrated in FIG. 3, so that the uniform rise of temperature can be attained virtually in the whole area of the hair.

Furthermore, since the heater 14 rotatingly radiates the infrared rays, even to the part of the hair where the radiation from the heater 14 does not reach the infrared rays are radiated in accordance with the shifting movement thereof, whereby the radiation of the infrared rays is uniformly applied to the whole area thereof.

Above all, since the temperature of the hair is detected by a non-contact type thermometer 17, the person whose hair is being treated does not suffer from a possible uncomfortable feeling caused by the fixation of the head, and consequently there will be no local overheating that may cause a damage to the hair.

Furthermore, the location shifting movement of a person's head can be sensed by a rise or fall of the temperature, in which state an electric bulb, buzzer and so on may be provided to notify the person of the movement of the head, whereby the location thereof may be adjusted.

And in addition, in the case that the rotation of the apparatus is somehow hampered by the fact that the heater 14 or the reflector 15 contacts to a surrounding wall, the magnets 8 and 9 are slipped off from each other, so that the rotating tube 6a fixed to the magnet 9 stops rotating and consequently the reflector 15 also stops, whereby the accidents such as mulfunction, damage to the wall and so on can be prevented.

Thus, due to the rotation of the heater 14 and the reflector 15, infrared rays can be radiated to a wider range than the widths thereof, whereby the size of the apparatus can be minimized to be more compact than the conventional apparatus.

In the above hair promoting method, the heater 14 may be arranged to stop automatically at the position indicated by the full line (rear part of the human head) as shown in FIG. 1 in the case that the infrared radiation is over or an instruction to stop the rotation thereof is issued.

Figure 4:
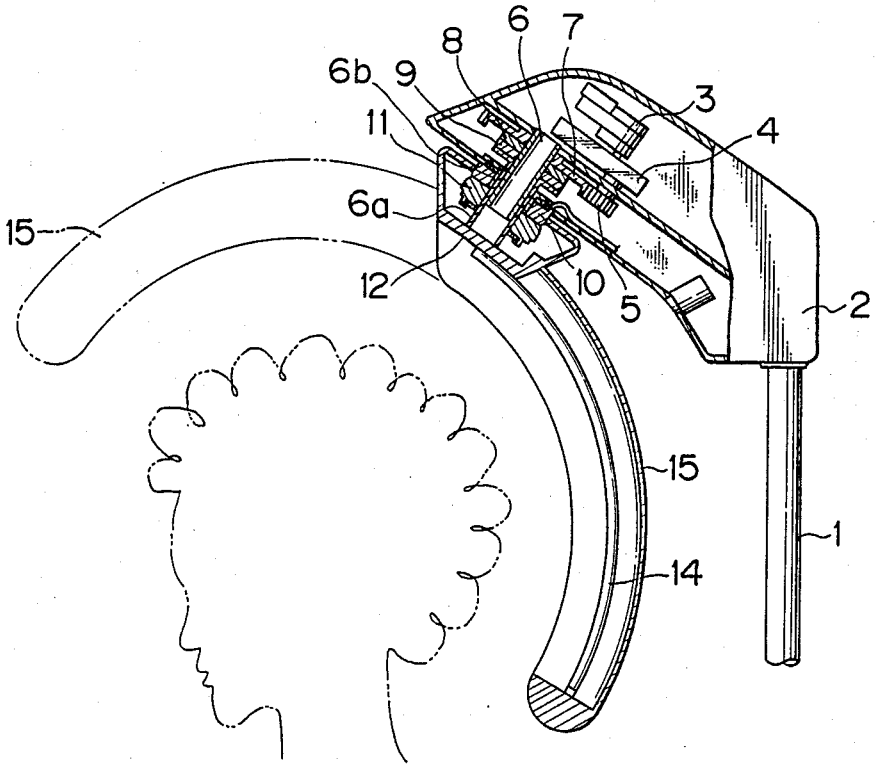
FIG. 4 is a sectional view of the second embodiment.
Figure 5:
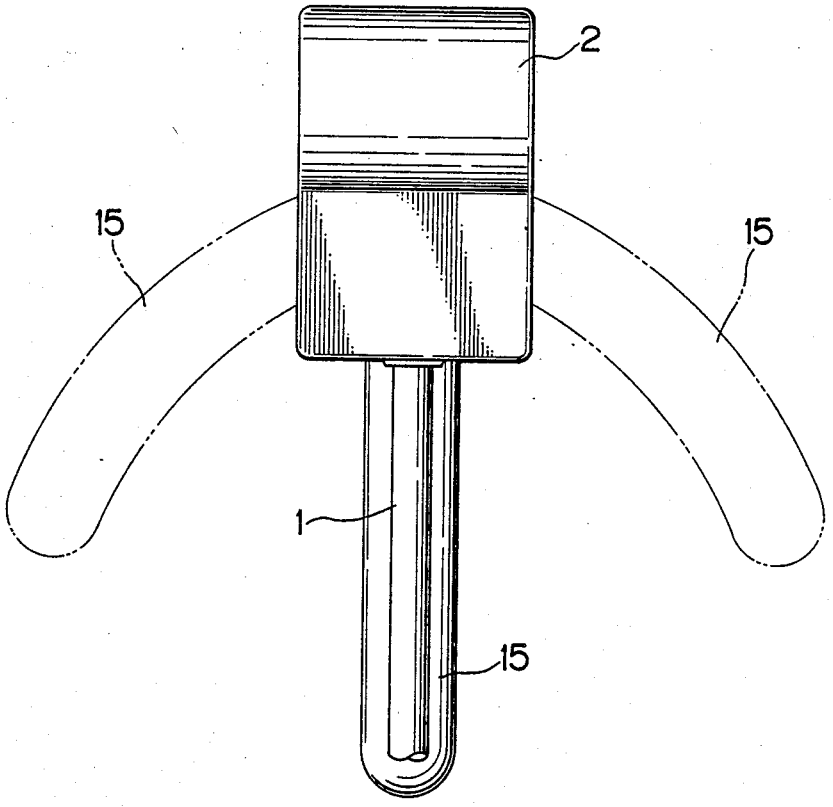
FIG. 5 is a rear side view of FIG. 4.

In the second embodiment as shown in FIGS. 4 and 5, nothing is different from the firstly shown embodiment except that the heater 14 and the reflector 15 formed in a ring-shape in the first embodiment are transformed into a semicircular shape, the same function and effects thus can be expected. By the way, the heater 14 and the reflector 15 may be divided into a plurality of heating apparatuses to form a ring shape by connecting those divided apparatuses.

The third embodiment of the present invention is explained below referring to FIG. 6.

In this embodiment, the hollow shaft 6 is rotatably supported by the main body case 2, and a fixed air blasting tube 22 connected to an air blower 20 whose one end is arranged inside the main body case 2 is connected to the upper end of the hollow shaft 6 through a rotating seal 21. Accordingly, the fixed air blasting tube 22 cannot possibly be twisted when the hollow shaft rotates.

Besides, the gear 7 and the magnet 8 are loosely attached to the hollow shaft 6, and the magnet 9 is also fixed thereto. Thus when the gear 7 rotates, the hollow shaft 6 is activated to rotate through the magnet 9 which is absorbed by the magnet 8.

Furthermore, the fixed side power feeder 10 is fixed to the main body case 2, while the rotatable side power feeder 11 is fixed to the hollow shaft 6. Thus, electric power from the main power supply is transmitted to the heater 14 by way of the fixed side power feeder 10 and the rotatable side power feeder 11.

On the other hand, a reflector 15 having a reflecting surface 15a forms an inner cavity therebetween, and a plurality of air blasting holes 23 are formed towards the same direction as that of the radiation therefrom. The inner cavity of the reflector 15 and the lower end of the hollow shaft 6 are connected to each other by the rotating air blower 24 which passes inside the arm 13.

Besides, a head fixing bar 25 is installed for fixing the position of the human head by contacting the rear portion thereof to the main body case 2, apart from which arrangement nothing is different from the first embodiment.

Accordingly, while promoting the human hair by directly and indirectly radiating infrared rays by utilization of the heater 14 and the reflecting, surface 15a, it also activates the air blower 20 to rotate simultaneously, so as to send hot or cool air to the inner cavity of the reflector 15 through the rotatably fixed air blasting tube 22, the hollow shaft 6 and the rotatable air blasting tube 24.

The above blasted air is blown out of the air blasting holes 23, in which case air regardless of cool or hot is blown into the human hair according to the heated level of the infrared rays so as to heat the whole area thereof for the hair promotion.

The above air blast may be performed when the hair heating is over.

Figure 7:
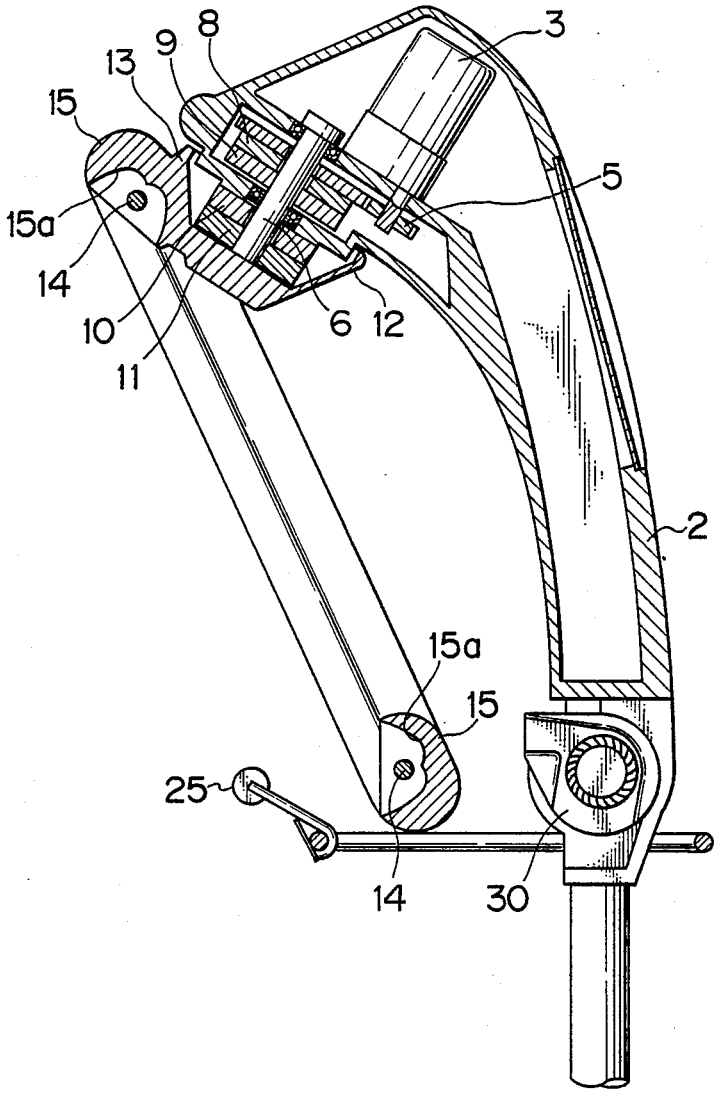
FIG. 7 is also a sectional view of the fourth embodiment.

The fourth embodiment according to the present invention as shown in FIG. 7 is explained below.

Figure 6:
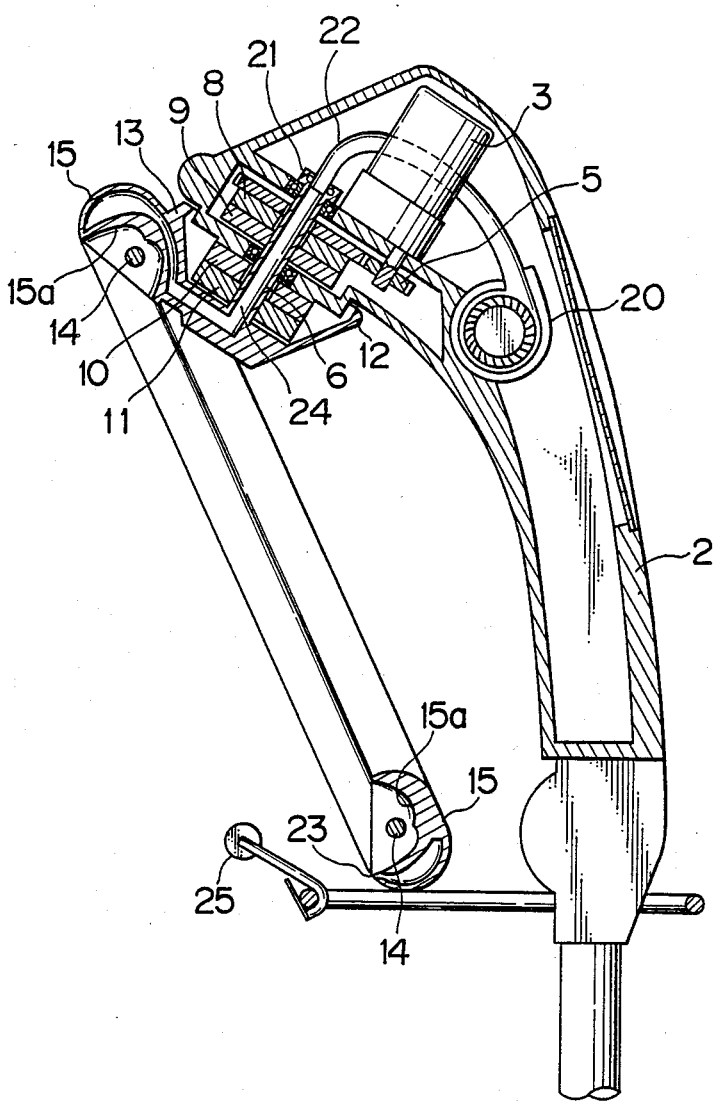
FIG. 6 is a sectional view of the third embodiment.

In this embodiment, instead of the former embodiment in which hot air blasted from the air blower 20 is blown out of the rotatable air blasting tube 24 through the hollow shaft 6, an air blower 30 directed to the rear portion of the human head is arranged near the lower end of the main body case 2, otherwise, there is no difference between those embodiments shown in FIG. 6 and FIG. 7.

In the above structure, the air from the air blower 30 is blown into the human head when the heater 14 and the reflector 15 rotate about the axis of the hollow shaft 16, and the location thereof is shifted from the front face of the blower 30, accordingly the same effect as the third embodiment is performed in promoting the hair treatment.

The present invention can also provide a function of a steamer by blowing a spray composed of supersonic waves from the hollow part of the shaft 6 together with the heated infrared radiation from the heater 14.

EFFECTS OF THE INVENTION

In the present invention as mentioned above, infrared rays are radiated simultaneously with eccentrical or reciprocative rotational movement of a heater and a reflector, whereby infrared-ray radiation can be applied to the wider area than the widths of the heater and the reflector themselves.

Consequently, the hair promoting apparatus can be compacted so as to be installed in a narrow beauty salon or the like.

Besides, since the heater and the reflector are formed in arcuatedly curved shape, the distance between the hair promoting apparatus and a human head which is nearly spherical can be uniformly accessed, so that a uniform rise of temperature due to the radiation of infrared rays in the whole area of the hair is made possible and consequently a possible uncomfortable feeling or pain caused by too much partial radiation can be prevented so as to enable a short-time hair promotion.

Furthermore, the radiation angle varies according to the rotation of a heater, whereby the area where the infrared radiation does not reach by the prior art can be radiated by utilization of the present invention, so that an uniform radiation of infrared rays to the entire area of the hair is enabled.

While the above infrared radiation is being performed or after the radiation is over, the surface portions of the human hair are constantly changed or raised higher than other portions, by activating the blower to blast hot or cool air to the hair, whereby the hair promotion can be performed in a better method.

Furthermore, in the case that the air blasting holes are arranged in the surface of the reflector, air is blasted to the location to which the heater radiates, and if an air blower is arranged in the main body case, the hair promotion can be improved regardless of the above heater's radiating direction.

What is claimed is:

1. A hair drying apparatus comprising a curved radiation element for radiating of infrared rays;

a reflector for supporting said radiation element and for reflecting infrared rays radiated from said element;

a rotating member for supporting rotatable motion of the reflector; and drive means for driving said rotating member, said drive means having a slip clutch mechanism for stopping the rotation of said rotating member when said radiation element and reflector strike an object during the rotation.

2. The hair drying apparatus as claimed in claim 1, wherein said curved radiation element has a semicircular configuration.

3. A hair drying apparatus as claimed in claim 1, wherein an air blower for blowing air towards said reflector is provided in a main body of said apparatus which supports said reflector.

4. A hair drying apparatus as claimed in claim 1, wherein said apparatus further comprises a non-contact type thermometer for detecting local over-heating of human hair being treated.

5. A hair drying apparatus as claimed in claim 1, wherein said reflector includes an inner cavity having a plurality of air blowing holes therein, said inner cavity being connected with an outlet for air blown from an air blower.

6. A hair drying apparatus claimed in claim 5 wherein said apparatus contains a human head settling bar.

7. A hair drying apparatus, comprising a radiation element for radiating infrared rays, a reflector for supporting said radiation element and for reflecting the infrared rays radiated by said element, said reflector being curved, a rotating member for supporting said reflector about an eccentric axis of rotation, whereby said curved reflector being spaced from a human head during it rotation to ensure uniform radiation of the human head.

8. The hair drying apparatus as claimed in claim 7, wherein said reflector rotates around the human head when said rotating member is rotated.

9. The hair drying apparatus as claimed in claim 7, wherein said radiation element is curved.

10. The hair drying apparatus as claimed 9, wherein the curvature of said radiation element substantially follows the curvature of the reflector.

11. The hair drying apparatus as claimed in claim 10, wherein the curvature of the radiation element and the curvature of the reflector have semicircular configuration.

12. An apparatus for radiating hair located on a human head, said head having at least anterior, upper and lower posterior portions, said apparatus, comprising a radiation element for radiating infrared rays, a reflector for supporting said radiation element and for reflecting infrared rays radiated by said element, a rotating member for supporting said reflector about an eccentric axis of rotation, whereby said apparatus radiates the hair in such a manner that radiation of the hair located on the upper posterior portion is substantially less than radiation of the hair located on the anterior and the lower posterior portions.

13. The apparatus for radiating hair located on a human head as claimed in claim 12, wherein said radiation element is a coil having a plurality of loops.

14. The apparatus for radiating hair located on a human head as claimed in claim 13, wherein said radiation element further comprises first and second radiation areas and a central radiation area positioned between said first and second radiation areas, said loops in said central radiation area being substantially less in number than the number of loops in said first and second radiation areas, so that intensity of the infrared rays radiated by said central area is substantially less than the intensity of infrared rays radiated by each said first and second radiation areas.

15. The apparatus for radiating hair located on a human head as claimed in claim 14, wherein said central radiation area radiates the hair located on said upper posterior portion of the head and said first and second radiation areas radiate the hair located on said anterior and lower posterior portions of the head.

16. The apparatus for radiating hair located on a human head as claimed in claim 14, wherein said reflector is arc-shaped in configuration.

17. The apparatus for radiating hair on a human head as claimed in claim 14, wherein said reflector is concave in shape.

* * * * *